United States Patent [19]

Kondo

[11] Patent Number: 4,764,042

[45] Date of Patent: Aug. 16, 1988

[54] PRINTING APPARATUS

[75] Inventor: Hiroatsu Kondo, Zushi, Japan

[73] Assignee: Canon Kabushiki Kaisha, Tokyo, Japan

[21] Appl. No.: 134,534

[22] Filed: Dec. 15, 1987

Related U.S. Application Data

[63] Continuation of Ser. No. 32,936, Apr. 1, 1987, abandoned, which is a continuation of Ser. No. 706,637, Feb. 28, 1985, abandoned.

[30] Foreign Application Priority Data

Mar. 6, 1984 [JP] Japan ..... 59-32394[U]

[51] Int. Cl.[4] ..... B41J 29/56

[52] U.S. Cl. ..... 400/674; 400/320; 400/335; 403/12

[58] Field of Search ..... 400/320, 674, 335, 144.2; 81/488; 29/270; 198/35, 854, 248; 188/65.1; 206/325, 319; 474/148–151, 273, 130; 70/57, 58, 174; 403/12; 24/31 R, 32; 112/121.14, 121.12

[56] References Cited

U.S. PATENT DOCUMENTS 4,300,847 11/1981 Hoffman et al. ..... 400/320 X
4,487,518 12/1984 Enrini ..... 400/320
4,576,496 3/1986 Schwarz et al. ..... 400/320 X

*Primary Examiner*—Charles Pearson
*Assistant Examiner*—Moshe I. Cohen
*Attorney, Agent, or Firm*—Fitzpatrick, Cella, Harper & Scinto

[57] ABSTRACT

A printer comprises printing means; a carriage on which this printing means is mounted; an endless, loop-like timing belt, fixed to the carriage, for moving the carriage, the surface of this endless belt which face with each other having serrated toothed portions; and a member for sandwiching the endless belt to stop the movement of the carriage. This printer may be also provided with an intermediate engaging member which is interposed between the upper and lower belts of the endless belt. This engaging member has serrated toothed portions having the same pitch as that of the serrated toothed portions of the endless belt. With this simple constitution, the carriage can be easily locked and unlocked without using special tools such as a screw and a screwdriver.

14 Claims, 4 Drawing Sheets

PRINTING APPARATUS

This application is a continuation of application Ser. No. 032,936 filed Apr. 1, 1987, now abandoned, which is a continuation of Ser. No. 706,637, filed Feb. 28, 1985, now abandoned.

BACKGROUND OF THE INVENTION

1. Field of the Invention

The present invention relates to a printing apparatus in which a carriage is moved by fixedly attaching the carriage to a timing belt which is rotationally moved by a driving source and, more particularly, to a printing apparatus of this type in which the carriage can be effectively fixed when this apparatus is carried.

2. Description of the Prior Art

Generally, in serial type printing apparatuses, a serrated toothed belt called a timing belt is rotationally moved by a pinion gear of a DC motor or pulse motor, thereby carrying the carriage fixed to the timing belt. However, in such a printing apparatus, the carriage could be freely moved due to vibration or the like during transportation from the factory to the location of its use, so that the carriage collides with the side wall or the like of the apparatus main body and parts might by broken. The carriage is gnerally fixed to the apparatus main body upon transportation to prevent such an accident and fixing means such as a screw or the like is usually used so far.

FIG. 1 shows an explanatory diagram in this case, in which a carriage 1 is in contact with a side wall 2 and the other end of the carriage is fixed by a screw 4 through a stopper member 3 in such a state. However, the user must use a tool such as a driver 5 or the like to remove this stopper member and an explanatory diagram regarding a method for removement of the stopper member as shown in FIG. 1 is needed.

SUMMARY OF THE INVENTION

The present invention is made in consideration of the foregoing drawback and intends to provide a printing apparatus which can easily release the lock without requiring any particular tool to cancel the lock of a carriage.

Another object of the invention is to provide a printing apparatus in which a carriage is moved by fixedly attaching the carriage to a loop-like timing belt which is rotationally moved by a driving source, wherein this apparatus is equipped with means for fixing the carriage by allowing the serrated toothed portions of the timing belt which face with each other to come into engagement with each other directly or through an interposing member.

DETAILED DESCRIPTION OF THE PREFERRED EMBODIMENTS

Figure 1:
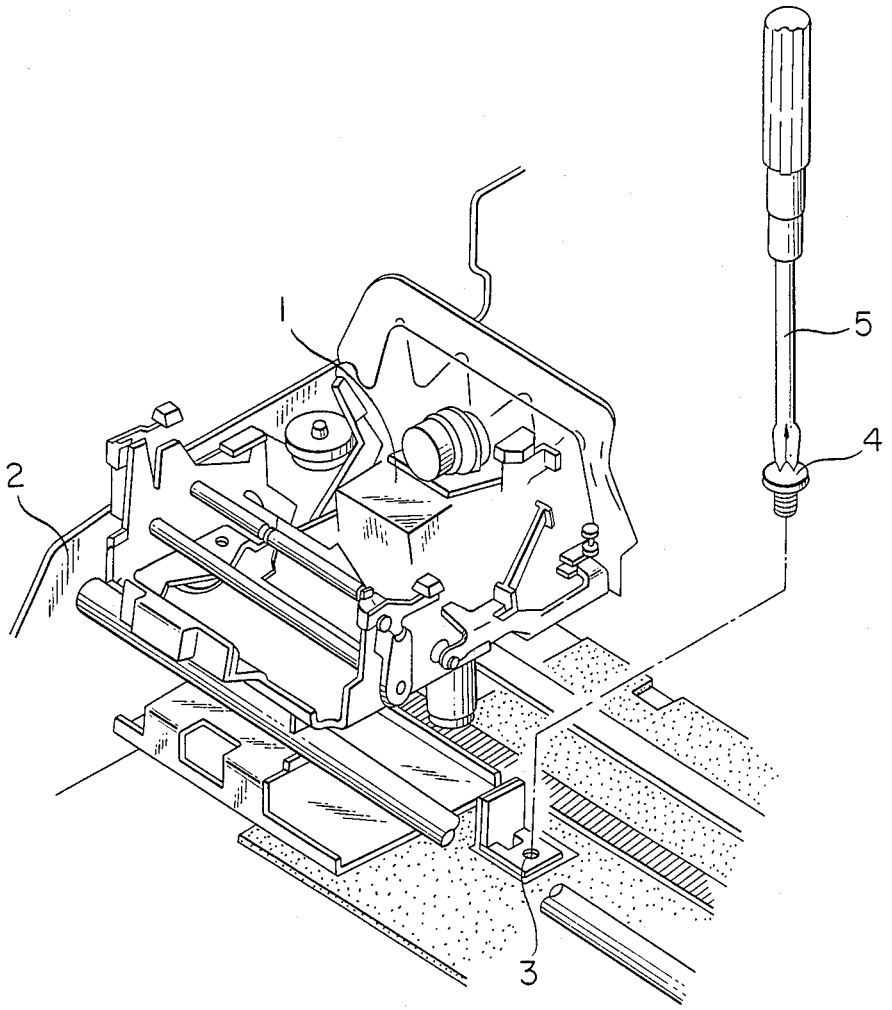
FIG. 1 PRIOR ART
FIG. 1 is a diagram for explaining a conventional method of fixing a carriage.
Figure 2:
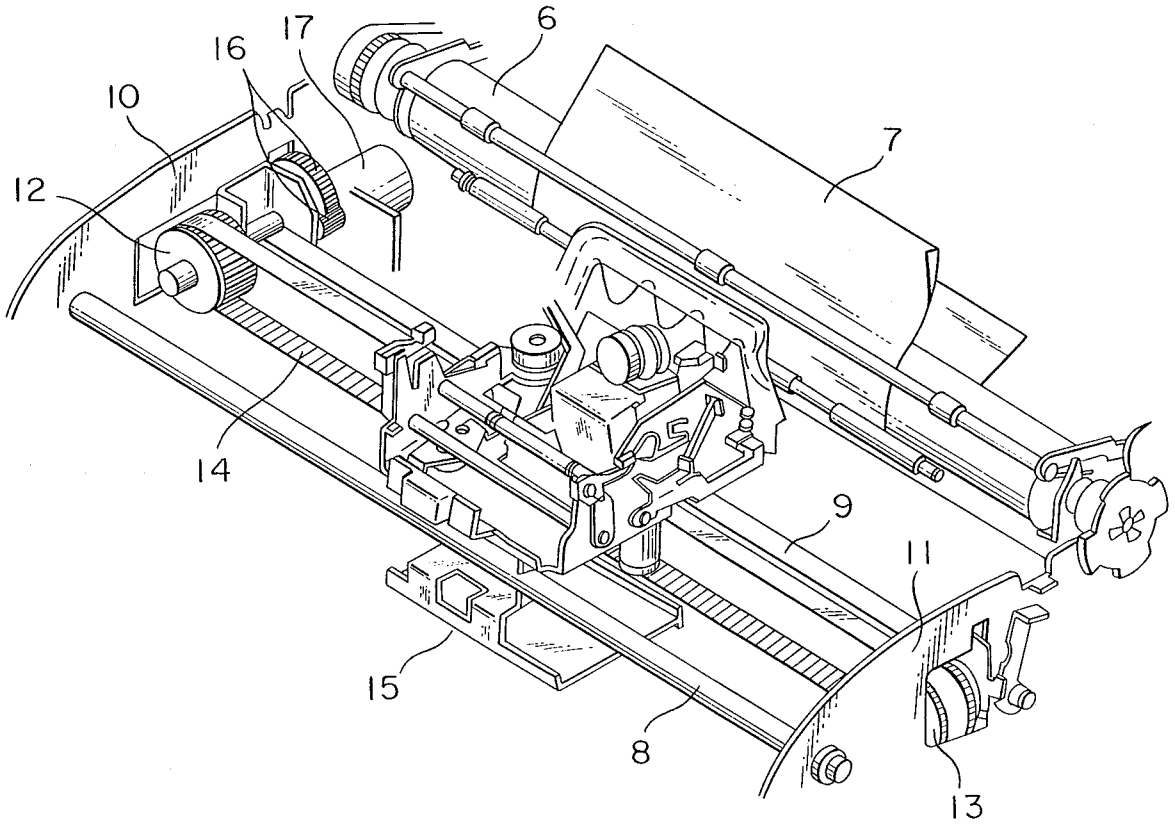
FIG. 2 is a perspective view illustrating an embodiment of the present invention.

FIG. 2 illustrates a printing apparatus according to an embodiment of the present invention, in which a print paper 7 is wound on a platen 6 and guide shafts 8 and 9 are arranged along this platen such that both ends of each of these guide shafts are supported by frames 10 and 11. On the other hand, a loop-like timing belt 14 is elastically tensioned and supported between the respective frames 10 and 11 by a pair of serrated toothed pulleys 12 and 13. Serrated toothed portions are formed on one surface of the timing belt 14 at a predetermined pitch and a carriage 15 is fixedly attached to this belt. The timing belt 14 is rotationally moved due to a motive power that is applied from a pulse motor 17 through a gear train 16, thereby allowing the carriage 15 to be moved reciprocatingly. A print unit as printing means is installed on the carriage and the print is sequentially performed by this print unit.

Figure 4:
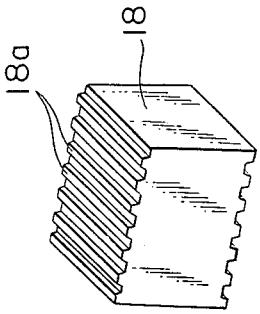
FIG. 4 is a perspective view of an intermediate engaging member.
Figure 3:
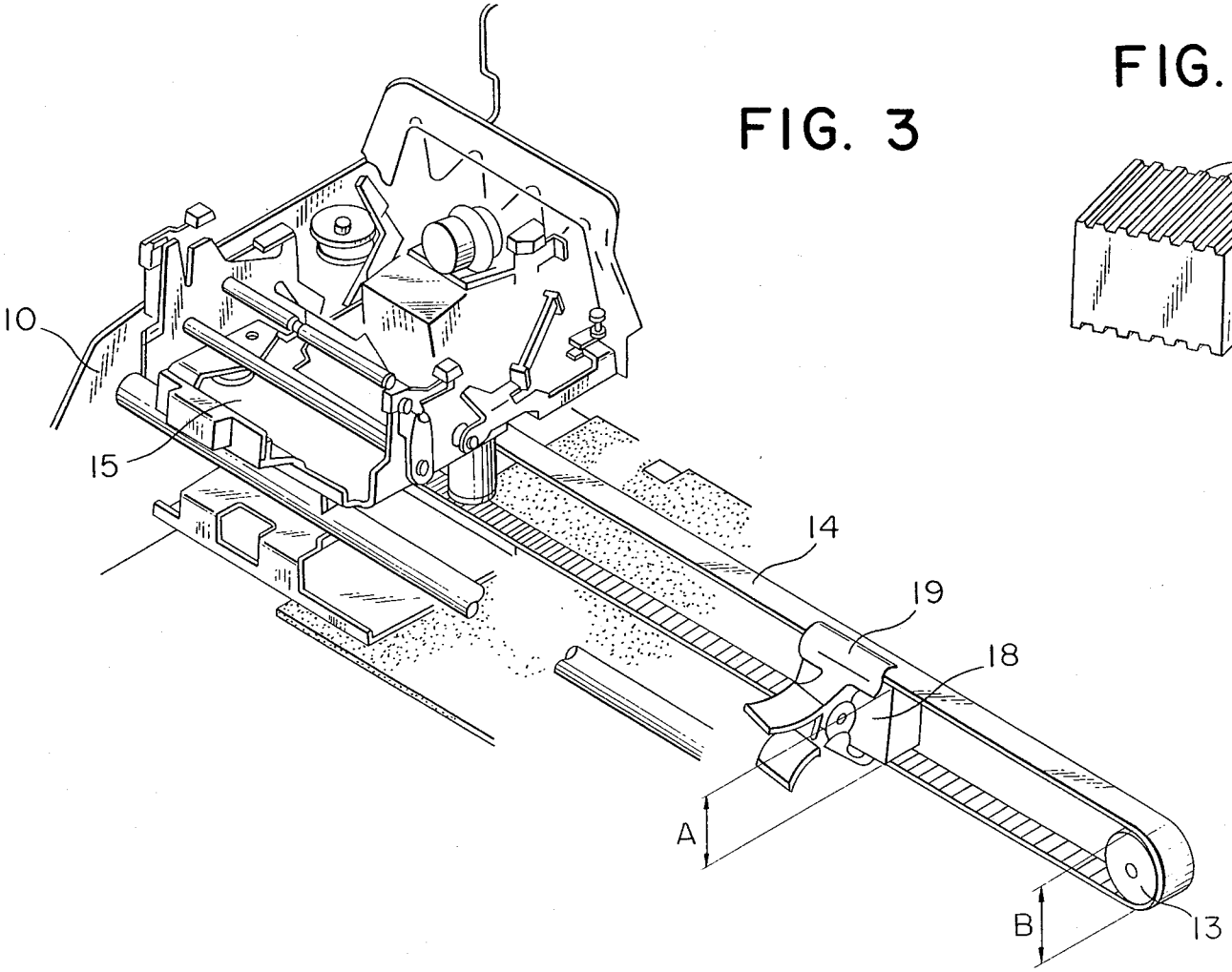
FIG. 3 is a perspective view showing the locked state of the carriage.

FIG. 3 illustrates a locking mechanism of the carriage. In the state whereby the left end portion of the carriage 15 is in contact with the frame 10, between the serrated toothed portions of the timing belt 14 which face with each other, an intermediate engaging member 18 (FIG. 4) having a gear train 18*a* of the same pitch as that of those serrated toothed portions is interposed. Then, this timing belt is sandwiched by a sandwiching tool 19 such as a clip or the like at the portion where the intermediate engaging member 18 was interposed in a manner such that a part of the upper belt and the intermediate engaging memeber 18 and a part of the lower belt are together sandwiched by the sandwiching tool 19. Thus, the serrated toothed portions of the timing belt 14 engage the gear train 18*a* of the intermediate engaging member 18, so that the rotation of the timing belt is inhibited and the carriage 15 is completely locked. In this case, a thickness of the intermediate engaging member 18 is set to be equal to a diameter B of each of the serrated toothed pulleys 12 and 13; therefore, the timing belt 14 is not extended when the carriage is locked.

Figure 5:
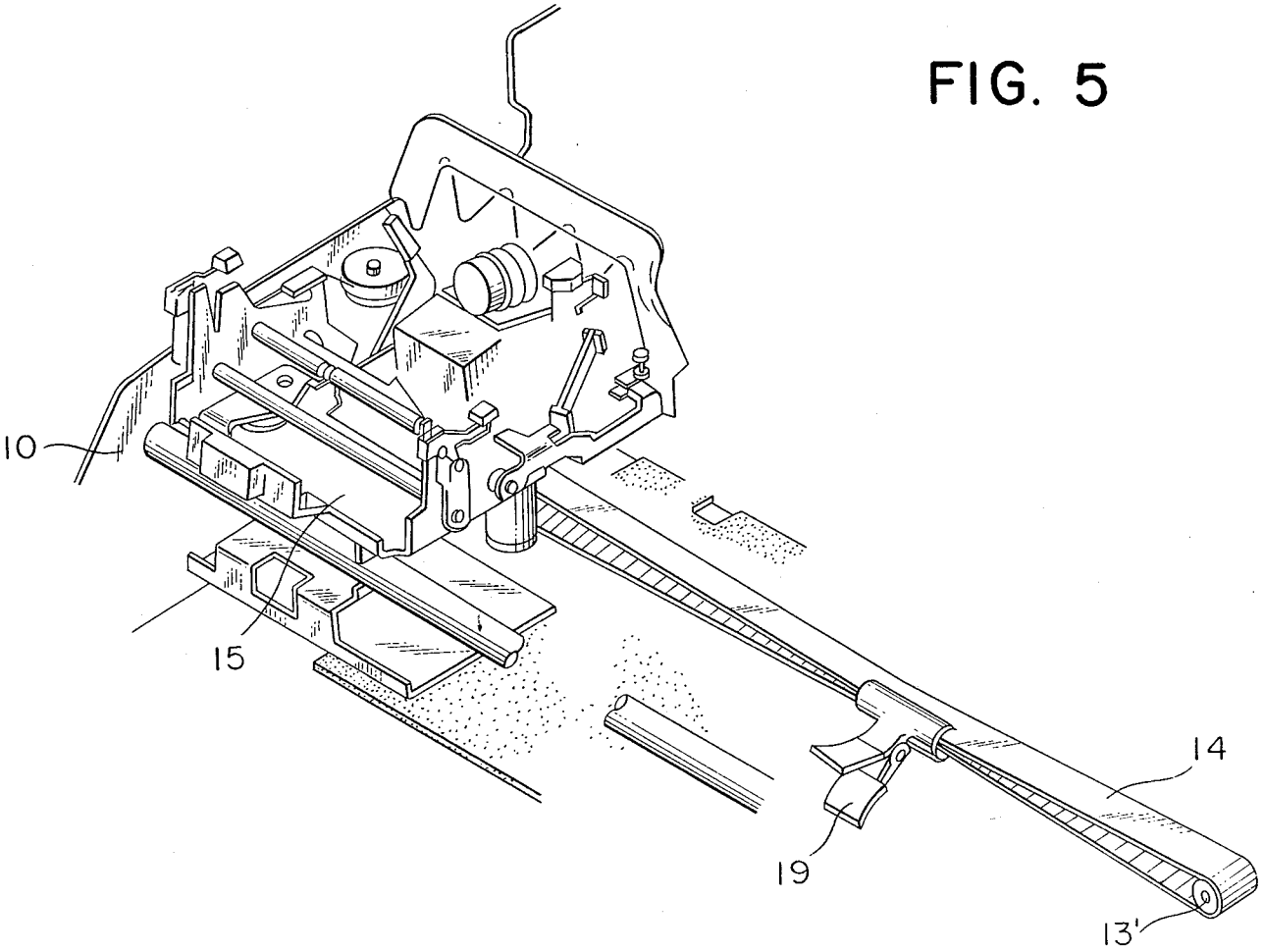
FIG. 5 is a perspective view illustrating another embodiment.

FIG. 5 illustrates a second embodiment of the present invention. When a diameter of a serrated toothed pully 13' is enough small, the intermediate engaging member 18 is not interposed between the upper and lower timing belts 14, but the belt is sandwiched directly by the sandwiching tool 19 in a manner such that the serrated toothed portions which face with each other are come into engagement with one another.

In the foregoing first and second embodiments, the carriage 15 is locked in the state whereby the carriage is in contact with the frame 10. In this case, the carriage can be locked irrespective of the position of the carriage. Further, if the sandwiching tool 19 is formed in conspicuous red or the like, this red color will inform the user that must remove the sandwiching tool, without requiring an explanatory diagram. Also, in this case, the carriage can be completely fixed by only a relatively cheap member without using a tool such as a screwdriver or the like.

According to the present invention as mentioned above, it is possible to provide a printing apparatus in which a carriage can be locked with an extremely simple constitution and this lock can be extremely easily cancelled without using any special tool and, therefore, its practical value is high.

What I claim is:

1. A printer comprising:

printing means;

a carriage on which said printing means is mounted;

two pulley means respectively disposed at opposite extremes of the travel of said carriage;

a belt for moving said carriage, said carriage being fixedly secured to said belt and said belt being applied onto said pulley means so that said belt includes two parallel parts extending between said two pulley means; and fixing means for fixing said belt to prevent said carriage from moving when said printer is carried, said fixing means being removed from said printer when said printer is in operation.

2. A printer according to claim 1, wherein said belt has teeth thereon and said fixing means is arranged to engage with said teeth of said belt.

3. A printer according to claim 2, wherein said fixing means includes an engagement member with a concave portion which can engage with said teeth of said belt.

4. A printer according to claim 3, wherein said engagement member is detachable.

5. A printer according to claim 1, wherein said fixing means includes a clip.

6. A printer comprising:

printing means;

a carriage on which said printing means is mounted;

a loop belt for moving said carriage, said carriage being fixedly secured to said loop belt;

two pulley means respectively disposed at opposite extremes of the travel of said carriage, said loop belt being applied onto said pulley means so that said loop belt includes two parallel parts extending between said two pulley means; and a manually detachable stop member for fixing said belt to prevent said carriage from moving when said printer is carried, said stop member being removed from said printer when said printer is in operation.

7. A printer according to claim 6, wherein said stop member includes a spacer held between said two parallel parts of said loop belt and a clip for securing said spacer to said loop belt.

8. A printer according to claim 7, wherein said loop belt has opposite concave and convex portions and said stop member makes an engagement between said concave and convex portions of said loop belt.

9. A printer according to claim 6, wherein said stop member is arranged to fix said parts of said loop belt between said two pulley means.

10. A printer comprising:

printing means;

a carriage on which said printing means is mounted;

two pulley means respectively disposed at opposite extremes of the travel of said carriage;

a belt for moving said carriage, said carriage being fixedly secured to said belt and said belt being applied onto said pulley means so that said belt includes two parallel parts extending between said two pulley means; and fixing means for fixing said belt to prevent said carriage from moving when said printer is carried, said fixing means being removed from said printer when said printer is in operation.

11. A printer according to claim 10, wherein said belt has teeth thereon and said fixing means is arranged to engage with said teeth of said belt.

12. A printer according to claim 11, wherein said fixing means has an engagement member with a concave portion which can engage with said teeth of said belt.

13. A printer according to claim 12, wherein said engagement member is detachable.

14. A printer according to claim 10, wherein said fixing means includes a clip.

* * * * *